US006247961B1

(12) United States Patent
McCoy

(10) Patent No.: US 6,247,961 B1
(45) Date of Patent: Jun. 19, 2001

(54) DISTRIBUTION WIRING HARNESS ASSEMBLY

(75) Inventor: Phillip A. McCoy, Albion, IN (US)

(73) Assignee: Group Dekko Services, LLC, Kendalville, IN (US)

( * ) Notice: Subject to any disclaimer, the term of this patent is extended or adjusted under 35 U.S.C. 154(b) by 0 days.

(21) Appl. No.: 09/604,194

(22) Filed: Jun. 27, 2000

(51) Int. Cl.[7] ..... H01R 4/24
(52) U.S. Cl. ..... 439/439
(58) Field of Search ..... 439/439, 441, 439/845, 849, 850, 854, 857, 859, 858, 860, 862, 883

(56) References Cited

U.S. PATENT DOCUMENTS

| | | | | |
|---|---|---|---|---|
| 2,720,634 | * | 10/1955 | Hart | 439/441 |
| 3,854,114 | | 12/1974 | Kloth et al. | 339/97 |
| 4,553,808 | | 11/1985 | Weidler et al. | 339/97 |
| 5,015,201 | * | 5/1991 | Brezee et al. | 439/441 |
| 5,030,143 | | 7/1991 | Hatagishi | 439/861 |
| 5,088,933 | | 2/1992 | Ribbeck | 439/395 |
| 5,088,934 | | 2/1992 | Chow et al. | 439/395 |
| 5,269,700 | | 12/1993 | Mitra | 439/395 |
| 5,306,177 | | 4/1994 | Burke et al. | 439/395 |
| 5,533,910 | | 7/1996 | Körner et al. | 439/395 |
| 5,584,714 | | 12/1996 | Karst et al. | 439/215 |
| 5,795,179 | * | 8/1998 | Lin | 439/441 |
| 6,039,597 | * | 3/2000 | Getselis et al. | 439/441 |
| 6,074,241 | * | 6/2000 | Patel et al. | 439/441 |

* cited by examiner

*Primary Examiner*—Tulsidas Patel
(74) *Attorney, Agent, or Firm*—Taylor & Aust, P.C.

(57) ABSTRACT

A distribution wiring harness assembly is electrically connected to at least one first contact of an electrical receptacle. The distribution wiring harness assembly includes a wire having an uninsulated segment and at least one insulated segment. A connector terminal includes at least one second contact mating with the at least one first contact of the electrical receptacle. At least two resilient prongs are connected to the at least one second contact. The at least two resilient prongs clamp the uninsulated segment of the wire therebetween.

22 Claims, 2 Drawing Sheets

DISTRIBUTION WIRING HARNESS ASSEMBLY

BACKGROUND OF THE INVENTION

1. Field of the Invention

The present invention relates to a distribution wiring harness for connection to an electrical receptacle, and, more particularly, to a connector terminal for such a distribution wiring harness.

2. Description of the Related Art

A modular wall panel assembly, also known as a partition or divider, is used in an office environment to define and separate work stations for individual workers. Such a wall panel assembly typically includes a wall panel with a wireway located at the bottom of the wall panel. The wireway is used to carry an electrical distribution harness which connects with an electrical distribution harness in an adjacent wall panel assembly. Electrical power may thus be distributed to the individual work stations through the electrical harness assemblies located in the modular wall panel assemblies.

A distribution wiring harness includes connector terminals each having at least one connector or contact which plugs into a respective mating connector or contact of an electrical receptacle, such as the electrical receptacle disclosed in U.S. Pat. No. 5,584,714. Insulated electrical wires within the distribution harness are crimped or soldered to respective connector terminals. Thus, each connector terminal electrically interconnects a wire to a selected connector or contact of the electrical receptacle.

A problem is that the process of crimping or soldering the insulated electrical wires to the connector terminals is labor and/or capital intensive. Another problem is that once the crimping and/or soldering of the wires has been performed, the wires cannot be easily decoupled from the connector terminals.

What is needed in the art is an easier and less expensive method of attaching a wire to a connector terminal to thereby electrically connect the wire to an electrical receptacle. What is further needed in the art is a method of attaching a wire to a connector terminal such that the wire can be easily decoupled from the connector terminal if desired.

SUMMARY OF THE INVENTION

The present invention provides an electrical connecter terminal which can be snapped into place onto a wire to thereby provide a secure electrical interconnection therebetween.

The invention comprises, in one form thereof, a distribution wiring harness assembly electrically connected to at least one first contact of an electrical receptacle.

The distribution wiring harness assembly includes a wire having an uninsulated segment and at least one insulated segment. A connector terminal includes at least one second contact mating with the at least one first contact of the electrical receptacle. At least two resilient prongs are connected to the at least one second contact. The at least two resilient prongs clamp the uninsulated segment of the wire therebetween.

An advantage of the present invention is that the need for crimping or soldering an insulated wire to a connecter terminal is eliminated.

Another advantage is that, even after the electrical connector terminal has been snapped into place onto the wire, the terminal can be relatively easily decoupled from the wire and snapped onto another wire if desired.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
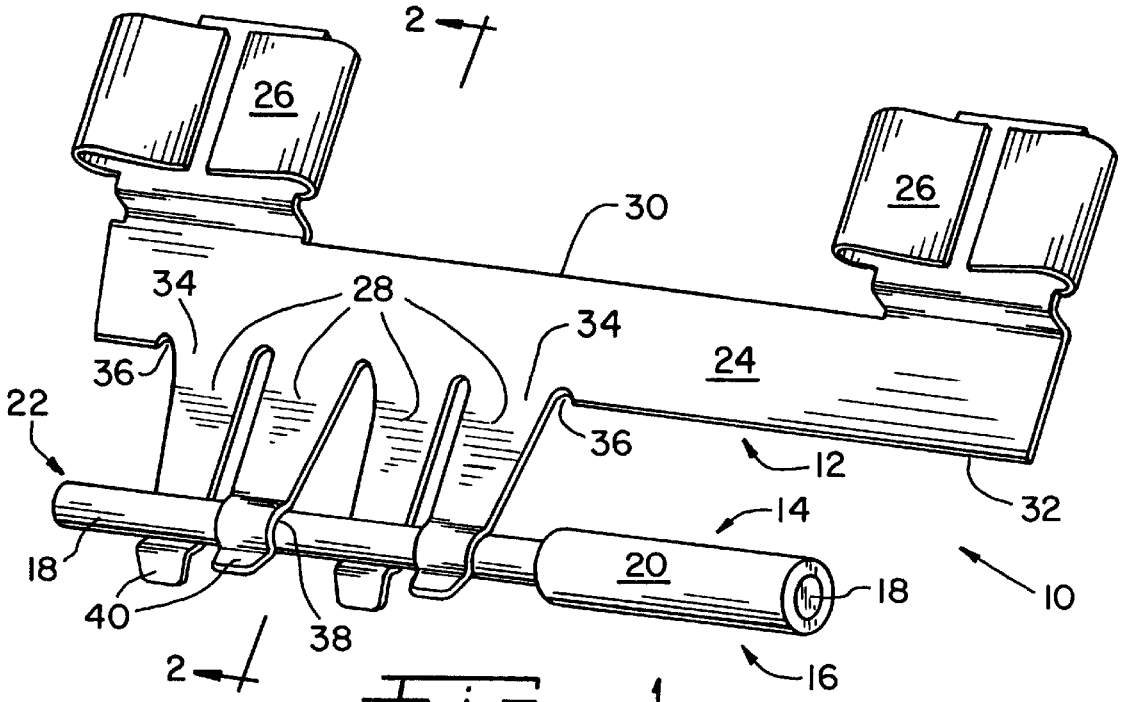
FIG. 1 is a perspective view of one embodiment of a distribution wiring harness assembly of the present invention.
Figure 2:
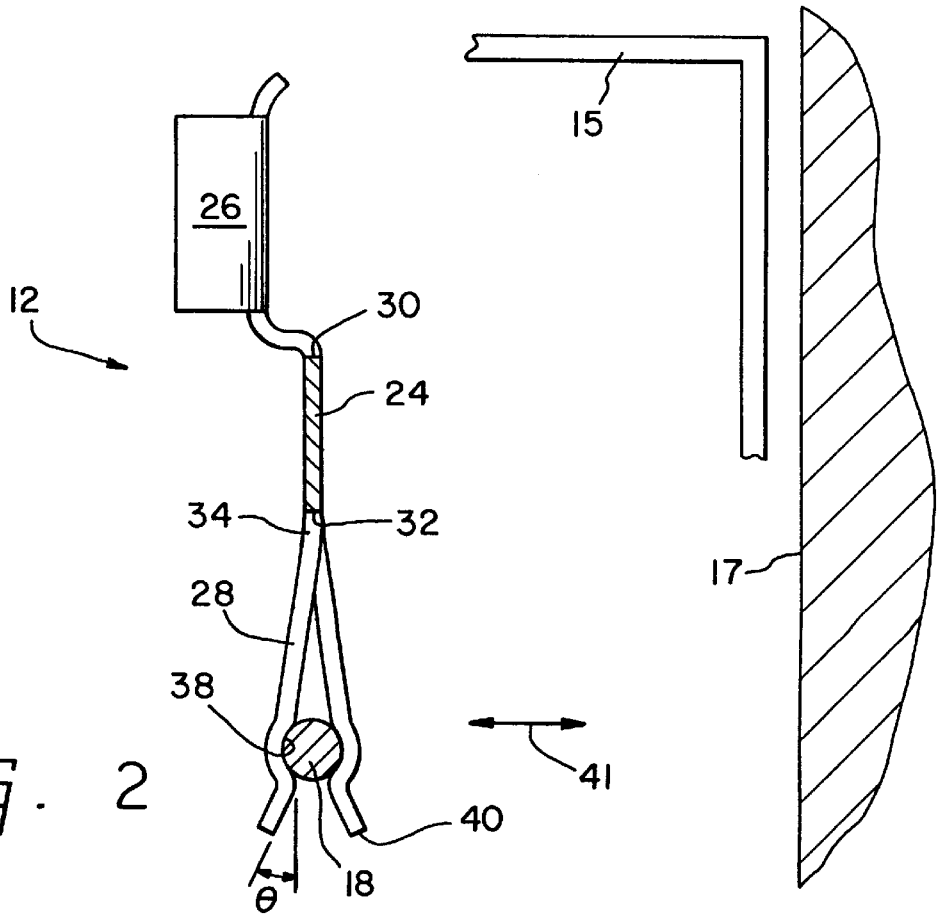
FIG. 2 is a side, sectional view of the distribution wiring harness assembly of FIG. 1.

Referring now to the drawings and more particularly to FIGS. 1 and 2, there is shown an embodiment of a distribution wiring harness assembly 10 of the present invention which may be connected to an electrical contact of a terminal within an electrical distribution block 15 disposed in a wall panel 17 (shown in fragmentary form in FIG. 2 for simplicity). The electrical distribution block is shown and discussed herein as being in the form of an electrical receptacle. However, the electrical distribution block may also be in the form of a power feed block, power/data block, L junction block or T junction block, for example. Distribution wiring harness assembly 10 includes a connector terminal 12 clampingly retaining a wire 14.

Wire 14 includes an insulated segment 16 wherein an electrical conductor 18 is covered by a layer of insulation 20, such as polyvinylchloride (PVC). Wire 14 also includes an uninsulated segment 22 wherein conductor 18 is bare, i.e., not covered by insulation 20.

Connector terminal 12 is monolithically formed of an electrically conductive metal and includes a planar body portion 24 interconnecting female contacts 26 and resilient prongs 28. Body portion 24 has two opposite edges 30 and 32 from which contacts 26 and prongs 28 respectively extend.

Contacts 26 are shown as being in the form of female contacts for receiving respective male contacts of the electrical receptacle. Alternatively, female contacts 26 may receive one end of a male connector, with the opposite end of the male connector being received in a corresponding female contact of the electrical receptacle.

Resilient prongs 28 are substantially coplanar with body portion 24 when prongs 28 are in an unbiased state, i.e., when prongs 28 are not engaging wire 14. The material as well as the thickness of prongs 28 is selected to provide proper resilient force and gripping of conductor 18 to ensure electrical contact. Prongs 28 include respective proximal ends 34 attached to edge 32 of body portion 24. Roundings 36 are provided adjacent to each proximal end 34 so that prongs 28 can flex about edge 32 without resulting in fatigue cracks in either body 24 or proximal ends 34.

Each prong 28 includes a respective, arcuate indentation 38 for securely retaining conductor 18. As best seen in FIG. 2, the shape of indentation 38 conforms to the cylindrical outer surface of conductor 18. Each indentation 38 faces a direction opposite to the direction faced by indentations 38 of adjacent prongs 28. A distal end 40 of each prong 28 is flared in the general direction of the corresponding indentation 38. That is, each distal end 40 is flared in a direction substantially opposite to the direction of flare of distal ends 40 of adjacent prongs 28.

During assembly, insulation 20 is stripped off of wire 14 to thereby expose the bare, uninsulated segment 22. Distal ends 40 of prongs 28 are then brought into engagement with the bare conductor 18. Due to the angles of orientation θ of flared ends 40, conductor 18 spreads prongs 28 apart in two opposite directions, indicated by double arrow 41, as conductor 18 is pressed thereagainst. In which of the two opposite directions 41 any individual prong 28 moves is dependent upon the direction of flare of the distal end 40 of that particular prong 28. Conductor 18 continues its progression between prongs 28 until conductor 18 finally snaps into place within indentations 38. In this position, prongs 28 securely hold conductor 18 in place, while at the same time, due to the large surface area of indentations 38 contacting the outer surface of conductor 18, providing a highly conductive electrical interconnection between conductor 18 and contacts 26.

If it is desired to replace wire 14 with another wire 14, conductor 18 can be easily disengaged from prongs 28 by pulling wire 14 toward distal ends 40, i.e., away from body portion 24. Alternatively, prongs 28 can be biased away from conductor 18 in the directions indicated by double arrow 41, possibly by hand, to thereby free conductor 18 from indentations 38.

Figure 3:
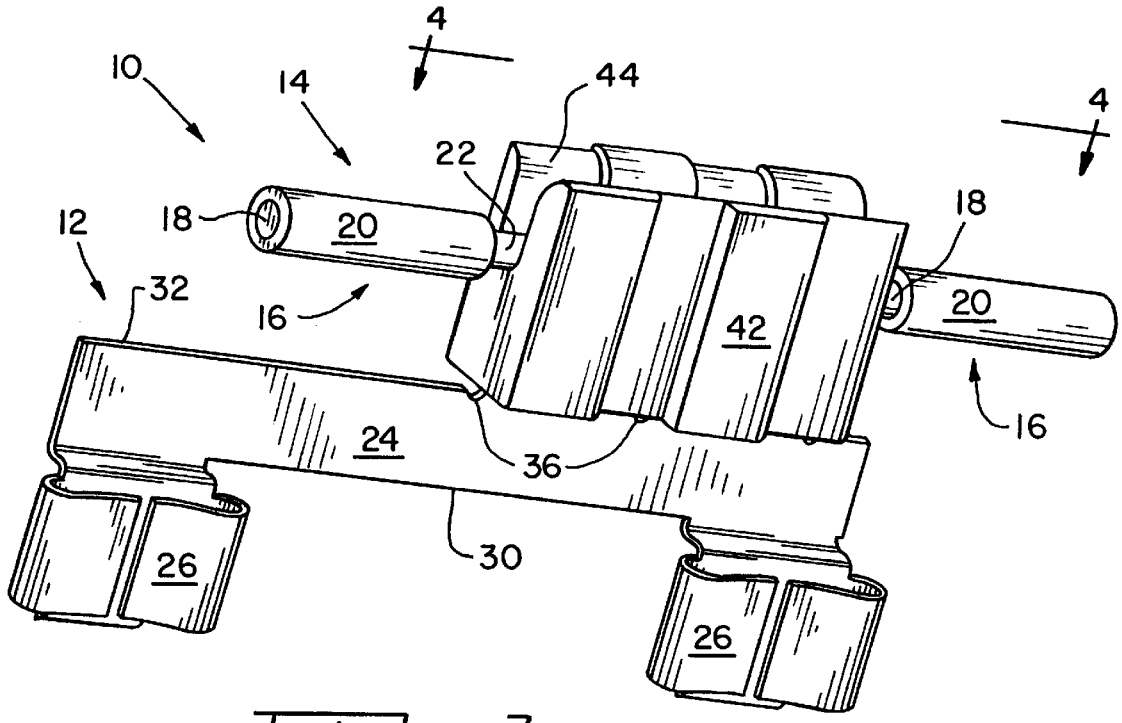
FIG. 3 is a perspective view of another embodiment of the distribution wiring harness assembly of the present invention.
Figure 4:
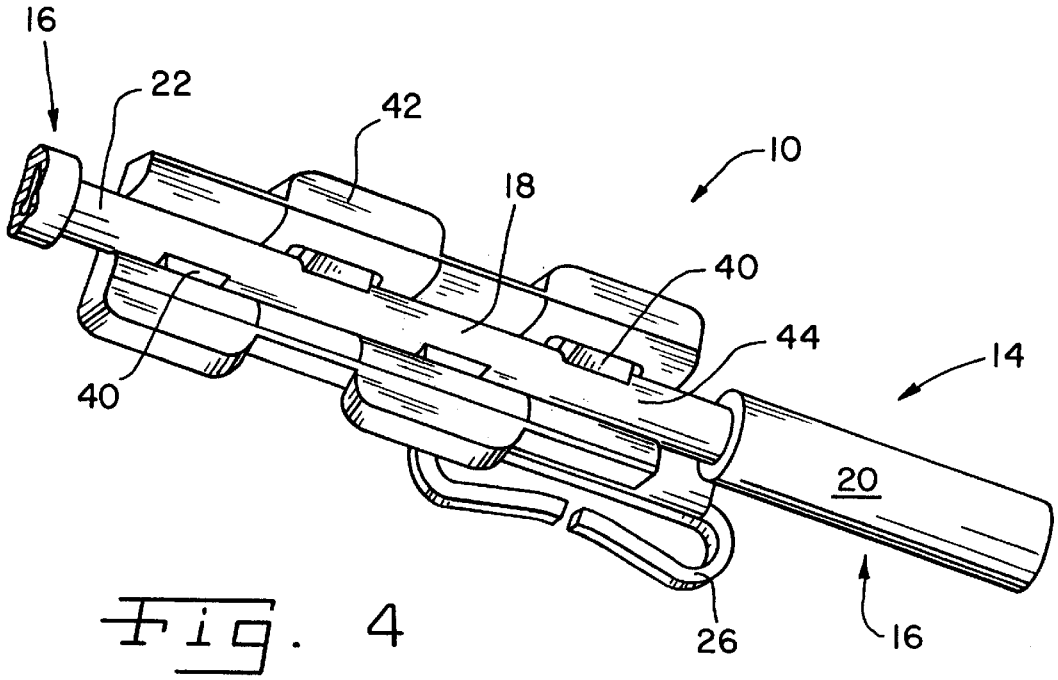
FIG. 4 is a top view of the distribution wiring harness assembly of FIG. 3.

In another embodiment (FIG. 3), a plastic housing 42 is molded around prongs 28. Plastic housing 42 has an opening 44 adjacent to distal ends 40 of prongs 28. Housing 42, similarly to prongs 28, is flared outward at opening 44 in order to allow conductor 18 to be easily placed and received therein. The non-conductive plastic housing 42 prevents the exposed conductor 18 and prongs 28 from being inadvertently shorted out against another electrical conductor and/or a grounded component.

Contacts 26 have been shown herein as being female contacts. However, it is to be understood that contacts 26 can also be of the male variety. Such male contacts would be received in female contacts of an electrical receptacle.

Four prongs 28 are shown in the drawings in alternating orientations. However, it is also possible for there to be as few as two prongs 28 or many more prongs 28 than four. Further, prongs 28 do not necessarily need to be in alternating orientations. For example, two adjacent prongs 28 may engage a same side of conductor 18 while the next two prongs 28 along the length of conductor 18 may engage the opposite side of conductor 18.

Distribution wiring harness assembly 10 allows connector terminal 12 to be electrically coupled with wire 14 using the plurality of prongs 28 which function as electrical terminals. Wire 14 is not provided with additional terminals for connection with prongs 28. Rather, prongs 28 couple directly with stripped wire 14. The present invention therefore completely eliminates a mating terminal of each mating pair, thereby reducing the amount of space required for electrical interconnection between connector terminal 12 and wire 14. Additionally, elimination of an electrical terminal which would conventionally be carried by wire 14 reduces manufacturing costs.

In the embodiment shown, prongs 28 are configured in a successively staggered relationship relative to each other such that the stripped portion of wire 14 is clamped therebetween. However, it is also possible to configure prongs 28 to clamp wire 14 from a single side, rather than opposite sides. For example, the housing in which wire 14 is disposed may be configured to support the side opposite from prongs 28 along intermittent locations such that resilient prongs 28 may all be disposed on the opposite side of the supporting structure and bias wire 14 against the supporting structure. Moreover, it may also be possible to configure wire 14 with sufficient rigidity to withstand clamping forces from a single side, or to apply an axial tension load to wire 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A distribution wiring harness assembly for being electrically connected to at least one first contact of an electrical receptacle, said distribution wiring harness assembly comprising:

a wire having an uninsulated segment and at least one insulated segment; and a connector terminal including:

at least one second contact configured for mating with the at least one first contact of the electrical receptacle;

at least two resilient prongs having proximal and distal ends, said distal ends configured for receiving and clamping therebetween said uninsulated segment of said wire; and a substantially planar, electrically conductive body interconnecting said at least one second contact and said prongs, said body being connected to said proximal ends of said prongs.

2. The connector terminal of claim 1, further comprising a plastic housing substantially surrounding said resilient prongs.

3. The connector terminal of claim 2, said plastic housing having an opening adjacent to said distal ends of said prongs for receiving the wire.

4. The connector terminal of claim 1, said body including at least one rounding adjacent to at least one said proximal end.

5. The connector terminal of claim 1, wherein said body includes a plurality of edges, said resilient prongs being aligned along one of said edges.

6. The connector terminal of claim 5, wherein said resilient prongs are substantially coplanar with said body when said resilient prongs are in an unbiased state.

7. A distribution wiring harness connector terminal for electrically connecting a wire to at least one first contact of an electrical distribution block, said connector terminal comprising:

at least one second contact configured for mating with the at least one first contact of the electrical distribution block;

at least two resilient prongs having proximal and distal ends, said distal ends being configured for clamping the wire therebetween; and an electrically conductive, substantially planar body interconnecting said at least one second contact and said prongs, said body being connected to said proximal ends of said prongs.

8. The connector terminal of claim 7, wherein said connector terminal is monolithic.

9. The connector terminal of claim 7, each said resilient prong being configured for clamping the wire such that said resilient prongs are spaced apart along a length of the wire.

10. The connector terminal of claim 9, wherein adjacent said resilient prongs are configured for clamping opposite sides of the wire.

11. The connector terminal of claim 9, wherein adjacent said resilient prongs have respective distal ends flared in substantially opposite directions.

12. The connector terminal of claim 9, wherein at least one said resilient prong includes an indentation for receiving the wire.

13. The connector terminal of claim 12, wherein said indentation is configured for substantially conforming to an outer surface of the wire.

14. The connector terminal of claim 13, wherein the outer surface of the wire is substantially cylindrical.

15. The connector terminal of claim 9, further comprising a plastic housing substantially surrounding said resilient prongs.

16. The connector terminal of claim 15, said plastic housing having an opening adjacent to said distal ends of said prongs for receiving the wire.

17. A method of electrically connecting a wire of a distribution wiring harness assembly to at least one first contact of an electrical distribution block, said wire having an uninsulated portion, said method comprising the steps of:

providing a connector terminal including:

at least one second contact;

at least two resilient prongs; and an electrically conductive substantially planar body interconnecting said at least one second contact and said at least two resilient prongs;

clamping the uninsulated portion of the wire between said at least two resilient prongs; and electrically connecting said at least one second contact of the connector terminal to the at least one first contact of the electrical distribution block.

18. The method of claim 17, wherein the wire comprises an electrical conductor substantially covered with a layer of insulation, said method comprising the further step of removing a segment of the insulation from a segment of the electrical conductor, said clamping step comprising clamping the segment of the electrical conductor between said at least two resilient prongs.

19. The method of claim 17, wherein adjacent said resilient prongs have respective distal ends flared in substantially opposite directions, said clamping step including pressing the wire and said flared distal ends together to thereby cause said adjacent resilient prongs to spread apart.

20. The method of claim 17, wherein at least one said resilient prong includes an indentation, said clamping step including moving the wire from a distal end of said at least one resilient prong toward a proximal end of said at least one resilient prong until the wire is received in said indentation.

21. An electrical distribution system, comprising:

a wall panel including an electrical distribution block having a terminal with at least one first contact; and a connector terminal including:

at least one second contact electrically connected to said at least one first contact of the electrical distribution block;

at least two resilient prongs clamping an uninsulated segment of wire therebetween; and a substantially planar body electrically interconnecting said at least one second contact and said at least two prongs.

22. The electrical distribution system of claim 21, wherein said electrical distribution block comprises an electrical receptacle.

* * * * *